US008643551B2

(12) United States Patent
Szini et al.

(10) Patent No.: US 8,643,551 B2
(45) Date of Patent: Feb. 4, 2014

(54) ACTIVE REDUCTION OF ELECTRIC FIELD GENERATED BY A TRANSMIT ANTENNA VIA AN AUXILLARY ANTENNA STRUCTURE

(75) Inventors: Istvan Szini, Grayslake, IL (US); Narendra Pulimi, Round Lake, IL (US); Martin R. Pais, North Barrington, IL (US)

(73) Assignee: Motorola Mobility LLC, Libertyville, IL (US)

( * ) Notice: Subject to any disclaimer, the term of this patent is extended or adjusted under 35 U.S.C. 154(b) by 538 days.

(21) Appl. No.: 12/603,354

(22) Filed: Oct. 21, 2009

(65) Prior Publication Data

US 2011/0090126 A1 Apr. 21, 2011

(51) Int. Cl.
*H01Q 1/52* (2006.01)
*H01Q 1/24* (2006.01)

(52) U.S. Cl.
USPC ..... 343/702; 343/841

(58) Field of Classification Search
USPC ..... 343/702, 841
See application file for complete search history.

(56) References Cited

U.S. PATENT DOCUMENTS

| | | | | |
|---|---|---|---|---|
| 6,765,536 | B2 * | 7/2004 | Phillips et al. | 343/702 |
| 6,957,051 | B1 * | 10/2005 | Korisch et al. | 455/107 |
| 7,541,991 | B2 * | 6/2009 | Qi et al. | 343/702 |
| 2003/0189518 | A1 | 10/2003 | Johnson et al. | |

FOREIGN PATENT DOCUMENTS

| | | |
|---|---|---|
| JP | 11284424 | 10/1999 |
| WO | 0156110 | 8/2001 |
| WO | 0199226 | 12/2001 |

OTHER PUBLICATIONS

Mangoud, M., et al., SAR Reduction for Handset with two-element phased array antenna computed using hybrid MoM/FDTD Technique, Electronic Letters, IEE Stevenage, vol. 35, No. 20, Sep. 30, 1999, pp. 1693-1694.
International Search Report PCT/US2010/053359 dated Jan. 19, 2011.
Balanis, C. A. "Fundamental Parameters of Antennas," Antenna Theory, Analysis and Design Second Edition, Chapter 2, pp. 32-33.
Balanis, C. A. "Region Separation," Antenna Theory, Analysis and Design Second Edition, Chapter 4, pp. 145-151.
Balanis, C. A. "Polarization Measurements," Antenna Theory, Analysis and Design Second Edition, Chapter 16, p. 879.

* cited by examiner

*Primary Examiner* — Douglas W Owens
*Assistant Examiner* — Jennifer F Hu

(57) ABSTRACT

A wireless communication device and method includes an auxiliary antenna that can actively cancel at least a portion of a near-field component of an electric field generated by a main transmit antenna. The auxiliary antenna can help comply with specific absorption rate requirements and can reduce undesirable signal rectification in hearing aid components.

12 Claims, 8 Drawing Sheets

ACTIVE REDUCTION OF ELECTRIC FIELD GENERATED BY A TRANSMIT ANTENNA VIA AN AUXILLARY ANTENNA STRUCTURE

TECHNICAL FIELD

The present invention generally relates to telecommunications, and more particularly to wireless communication devices and cancellation of portions of electric fields generated by such devices.

BACKGROUND

Wireless communication devices (i.e., cellular phones, digital wireless phones, wireless terminals, etc.) communicate with base-stations using radio-frequency (RF) transmissions. Wireless communication devices emit electromagnetic energy from the antennas and backlights or other components and hence can exhibit a relatively strong electromagnetic (EM) field. In particular, RF transmissions from antennas can cause EM fields to radiate around the wireless communication device that can sometimes interfere with other electrical devices operating nearby.

For instance, emissions from a wireless communication device can interfere with operation of a hearing aid (or cochlear implant). Such emissions are undesirable since they are rectified by the hearing aid causing a hum, whistle or buzzing sound to be emitted by the hearing aid's speaker. When the user of a hearing aid experiences such interference this makes it difficult or impossible for them to hear conversations taking place over the wireless communication device. In this regard, manufacturers of digital wireless communication devices will soon be obliged to produce digital wireless communication devices for the hearing impaired. For example, in the United States, the Federal Communications Commission (FCC) recently modified the previous exemption to the Hearing Aid Compatibility (HAC) Act of 1988 and established rules for the hearing aid compatibility of digital wireless telephones. Specifically, the FCC required that that digital wireless telephone manufacturers and digital wireless service providers make certain numbers of models or percentages of all digital wireless phones accessible to individuals who use hearing aids. Wireless phones which meet this new requirement are sometimes referred to as HAC-compliant terminals.

Accordingly, it is desirable to reduce the incidence of an electric near-field generated by a digital wireless communication device against a hearing aid to thereby reduce or mitigate undesirable signal interference with hearing aid components when in use, and thus provide improved digital wireless communication equipment that are HAC-compliant. It is also desirable to provide digital wireless communication devices that control near-field emissions absorbed by a user of a wireless communication device to comply with Specific Absorption Rate (SAR) requirements set for wireless communication devices by various government entities. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

Figure 1:
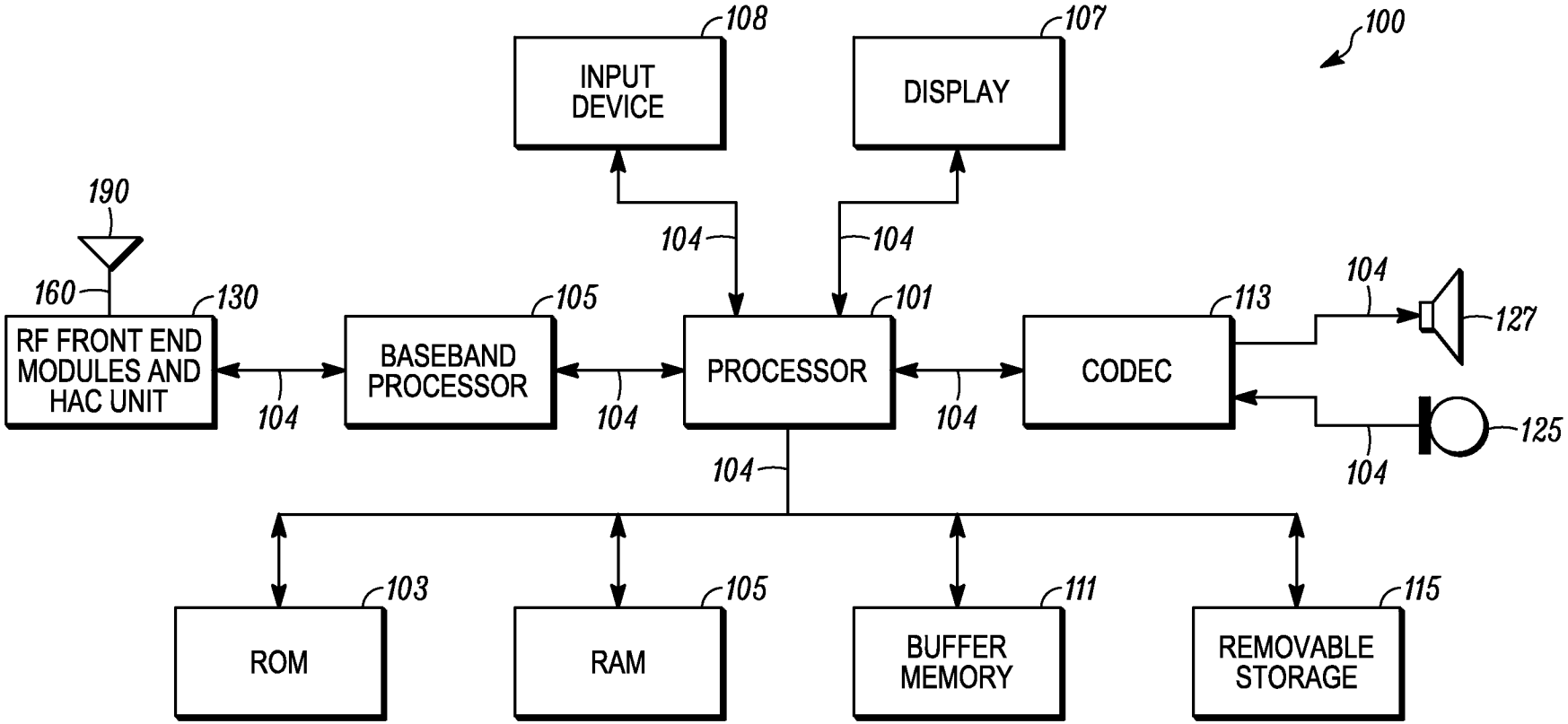
FIG. 1 is a block diagram of an exemplary wireless computing device.

As used herein, the word "exemplary" means "serving as an example, instance, or illustration." The following detailed description is merely exemplary in nature and is not intended to limit the invention or the application and uses of the invention. Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary or the following detailed description.

Before describing in detail embodiments that are in accordance with the present invention, it should be observed that the embodiments reside primarily in combinations of apparatus components related to controlling electric fields radiated by a wireless communication device. The wireless communication device implements transmit diversity techniques and includes apparatus components designed to actively cancel at least a portion (e.g., the near-field component) of an electric field generated by a main transmit antenna. This can, for example, reduce the specific absorption rate experienced by a user of the device, and can reduce undesirable signal rectification on hearing aid components. Signal rectification refers to the situation where RF energy transmitted by a cellular telephone is received by the circuitry in a hearing aid and such energy is audio rectified across a non-linear junction resulting in a "buzz" produced by the hearing aid.

As used herein, the term "near-field" refers to a portion or region of an EM field in the immediate vicinity of the source of the emission, such as the area immediately adjacent the antenna, and may for example refer to the area where the angular field distribution is dependent upon the distance from the antenna. Those skilled in the art will recognize that the size of the near field will depend upon the wavelength of the emission and the geometry of the source. By way of example, the near-field may be thought of as a relatively intense field impacting a user in physical contact with the wireless communication device proximate the area of physical contact with the wireless communication device.

By contrast, the far-field region is a region outside the near-field region. As used herein, the term "far-field" refers to a portion or region of an EM field relatively far from the source of the emission and in which the radiation pattern does not change shape with distance. For example, the far field could be thought of as a field impacting a person at a point a meter away from a wireless communication device's emission source.

In accordance with some of the disclosed embodiments, a method of operating a wireless communication device is provided. A "first" magnitude of an amplified RF signal is reduced to generate a drive signal having a "second" magnitude that is less than the first magnitude. The phase of the drive signal is shifted to generate a phase-shifted drive signal having an angle that is phase shifted with respect to the amplified RF signal. A main antenna is driven with the amplified RF signal to radiate a first electric field having a "first" near-field component with a "first" magnitude and having a maximum intensity at a hot spot location, and an auxiliary antenna structure is driven with the phase-shifted drive signal to radiate a second electric field having a "second" near-field component with a "second" magnitude that reduces the first magnitude of the first electric field at the hot spot location. In other words, the second near-field component can reduce and/or cancel the first near-field component of the first electric field at the hot spot location. As used herein, the term "hot spot location" refers to a region, area or volume where the near-field component of an electric field has its maximum intensity.

In accordance with other disclosed embodiments, a wireless communication device is provided that includes a housing, an RF front end module designed to generate an amplified RF signal having a first magnitude, a main antenna disposed inside the housing, a coupler, a phase shifter, an auxiliary antenna structure disposed inside the housing, and a an earpiece speaker integrated within the housing. The coupler reduces the magnitude of the amplified RF signal to generate a drive signal having a second magnitude that is less than the first magnitude, and the phase shifter shifts the phase of the drive signal to generate a phase-shifted drive signal having an angle that is phase shifted with respect to the amplified RF signal. In response to the amplified RF signal, the main antenna radiates a first electric field having a maximum intensity at a hot spot location, and the auxiliary antenna structure radiates a second electric field in response to the phase-shifted drive signal. The auxiliary antenna structure can be oriented to radiate the second near electric field having a second near-field component that is in the same orientation as the first near-field component of the first electric field generated by the main antenna. The second near-field component of the second electric field has sufficient magnitude at the hot spot location such that when it is superposed on the first near-field component of the first electric field, the first near-field component of the first electric field that is incident at the hot spot location is reduced and/or cancelled. In other words, the second near-field component of the second electric field destructively interferes with the first near-field component of the first electric field generated by the main antenna to reduce the first near-field component of the first electric field at the hot spot location. In one implementation, the auxiliary antenna structure can be disposed in close proximity to the earpiece speaker and beneath or underneath the hot spot location. In one particular implementation, the auxiliary antenna structure can be a non-resonant auxiliary antenna structure, and the phase shifter can be an adjustable phase shifter that allows the phase shift applied to the drive signal to be adjusted so that intensity of the second electric field radiated by the auxiliary antenna can be pre-set and/or controlled by a user.

Exemplary Wireless Communication Device

FIG. 1 is a block diagram of an exemplary wireless computing device 100. As used herein, the term "wireless computing device" refers to any portable computer or other hardware designed to communicate with an infrastructure device over an air interface through a wireless channel. In many cases a wireless computing device is "handheld" and potentially mobile or "nomadic" meaning that the wireless computing device 100 can physically move around, but at any given time may be mobile or stationary. The wireless computing devices 100 can be one of any of a number of types of mobile computing devices, which include without limitation, mobile stations (e.g. mobile telephone handsets, mobile radios, mobile computers, hand-held or laptop devices and personal computers, a PC card, personal digital assistants (PDAs), or the like), access terminals, subscriber stations, user equipment, compact flash, external or internal modem, or any other devices configured to communicate via wireless communications. The wireless computing device 100 can communicate in accordance with any known wireless communication standards including telecommunication standards such as $3^{rd}$ Generation Partnership Project (3GPP), $3^{rd}$ Generation Partnership Project 2 (3GPP2), Global System for Mobile communication (GSM), Code Division Multiple Access (CDMA), Wide-band CDMA (WCDMA), Universal Mobile Telecommunications System (UMTS), LTE and the like) and those based on ad hoc networking standards (e.g., IEEE 802.11, IEEE 802.16, Worldwide Interoperability for Microwave Access (WiMax), and the like). The wireless computing device 100 is designed to operate over a cellular air interface (e.g., Global System for Mobile communication (GSM), Code Division Multiple Access (CDMA), Wide-band CDMA (WCDMA), Universal Mobile Telecommunications System (UMTS), and the like) and/or an ad hoc networking air interface (e.g., IEEE 802.11 WLAN interfaces, IEEE 802.16 interfaces, Worldwide Interoperability for Microwave Access (WiMax) interfaces, and the like).

The wireless computing device 100 comprises an antenna 160, an RF front end module and HAC unit 130, a baseband processor 105, a processor 101, a coder/decoder (CODEC) 113, a display 107, input devices 108 (keyboards, touch screens, etc.), a program memory 103, 105 for storing operating instructions that are executed by the processor 101, a buffer memory 111, a removable storage unit 115, a microphone 125 and an earpiece speaker 127 (i.e., a speaker used for listening by a user of the device 100). The various blocks are coupled to one another as illustrated in FIG. 1. In some implementations, the various blocks can communicate with one another via a bus, such as a PCI bus. The wireless computing device 100 can also include a power source such as a battery (not shown). The wireless computing device 100 can be an integrated unit containing at least all the elements depicted in FIG. 1, as well as any other elements necessary for the wireless computing device 100 to perform its particular functions.

The processor 101 controls an overall operation of the wireless computing device 100. The processor 101 can include one or more microprocessors, microcontrollers, DSPs (digital signal processors), state machines, logic circuitry, or any other device or devices that process information based on operational or programming instructions. Such operational or programming instructions can be, for example, stored in the program memory that may be an IC (integrated circuit) memory chip containing any form of RAM (random-access memory) or ROM (read-only memory), a floppy disk, a CD-ROM (compact disk read-only memory), a hard disk drive, a DVD (digital video disc), a flash memory card or any other medium for storing digital information. In one implementation, the Read Only Memory (ROM) 103 stores microcodes of a program for controlling the processor 101 and a variety of reference data, and the Random Access Memory (RAM) 105 is a working memory of the processor 101 and temporarily stores data that are generated during the execution of the program. The buffer memory 111 may be any form of volatile memory, such as RAM, and is used for temporarily storing received information packets. The removeable storage 115 stores a variety of updateable data, and can be implemented using Flash RAM. One of ordinary skill in the art will recognize that when the processor 101 has one or more of its functions performed by a state machine or logic circuitry, the memory 103, 105 containing the corresponding operational instructions may be embedded within the state machine or logic circuitry.

The coder-decoder (CODEC) 113 communicates with the processor 101 over a bus 104. The speaker 127 and the microphone 125 connected to the codec 313 serve as an audio input/output block for communication. The CODEC 113 converts digital data from the processor 101 into analog audio signals and outputs the analog audio signals through the speaker 127. Also, the CODEC 113 converts audio signals received through the microphone 125 into digital data and provides the digital data to the processor 101.

Working together the RF front end module 130 and baseband processor 105 enable the wireless computing device 100 to communicate information packets over the air and acquire information packets that are processed at the processor 101. In this regard, the RF front end module 130 and baseband processor 105 include conventional circuitry to enable transmissions over a wireless communication channel. The implementations of the RF front end module 130 and baseband processor 105 depend on the implementation of the wireless computing device 100. In general, the baseband processor 105 processes the baseband signals that are transmitted/received between the RF front end module 130 and the processor 101. The RF front end module 130 down-converts the frequency of an RF signal received through an antenna 190 and provides the down-converted RF signal to a baseband processor 105.

The baseband processor 105 receives digital baseband data (originally generated at the CODEC 113) from the processor 101 and converts the baseband data into real (I) and imaginary (Q) data streams. Although not shown, RF front end module 130 can also include conventional transmitter circuitry including a modulator, an upconverter module and a power amplifier. The modulator (not shown) is designed to modulate information from the baseband processor 105 onto a carrier frequency. The frequency of the modulated carrier is upconverted by the upconverter module to an RF frequency to generate an RF signal. The RF signal is amplified by a power amplifier (not shown) to a sufficient power level for radiation into free space and transmitted via the antenna 190. Although not shown, the RF signal is provided from the power amplifier to the antenna 190 over a transmission path between the power amplifier and antenna 190. In one embodiment, the transmission path is a hardwired path that includes one or more connectors and one or more sections of coaxial cable (e.g., 50 ohm RF transmission cable).

The main antenna 160 comprises any known or developed structure for radiating and receiving electromagnetic energy in the frequency range containing the wireless carrier frequencies. The antenna 160 is coupled and matched to the electronic circuitry of the communication device 100 as is known in the art. As such, other elements (not shown) such as an antenna switch, duplexer, circulator, or other highly isolative means can also be present.

Figure 2:
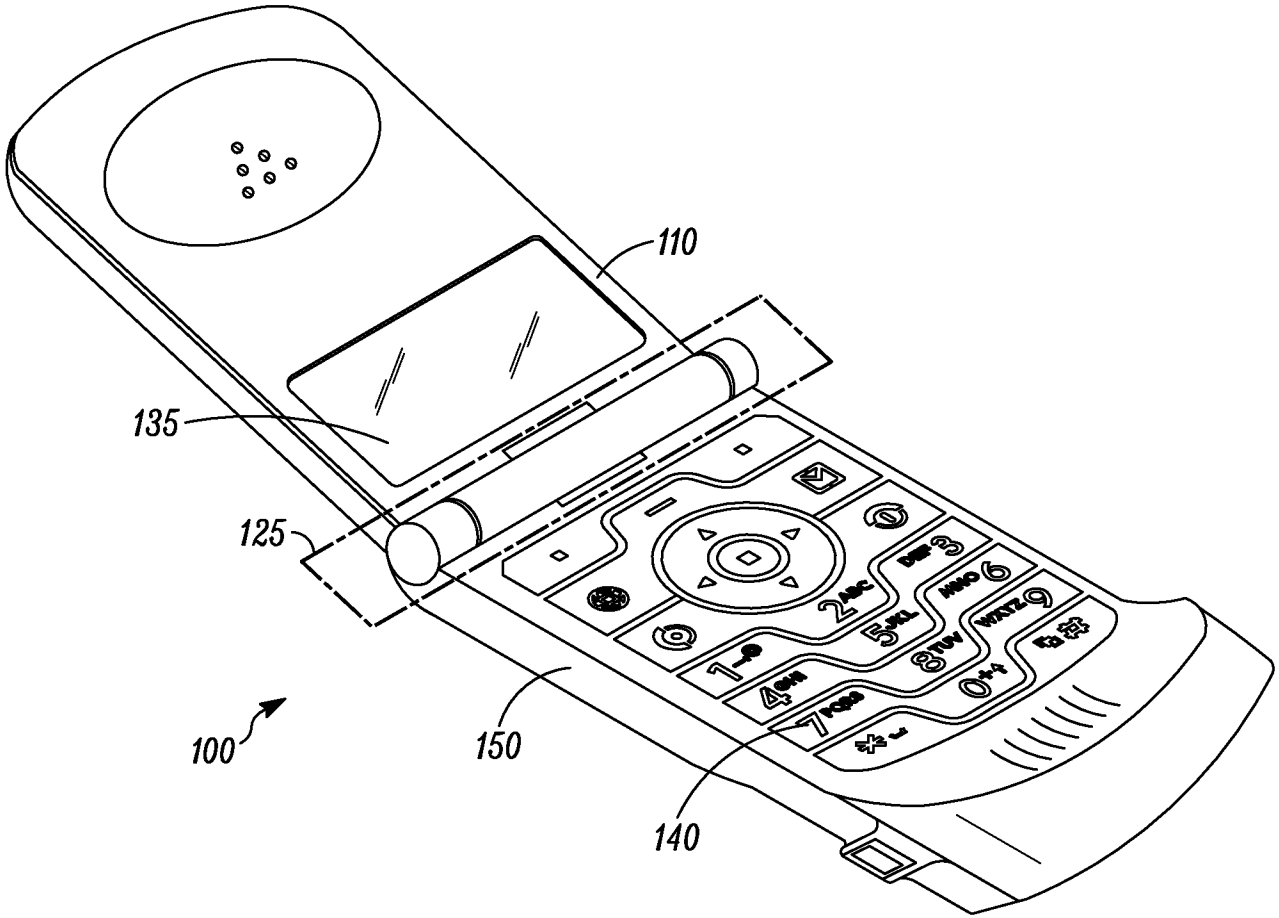
(PRIOR ART) FIG. 2
FIG. 2 illustrates an exemplary housing of a wireless communication device in which the blocks of FIG. 1 can be implemented in accordance with one exemplary implementation.

Prior to describing that HAC unit with reference to FIG. 3, one example of a housing for the various blocks of the wireless communication device 100 in FIG. 1 will be described with reference to FIG. 2. Although FIG. 2 illustrates one example of a flip type housing with a hinged connection, any other known housing types can be used in conjunction with the disclosed embodiments. These can include, for example, monoblock wireless communication devices and extendable slide wireless communication devices. Monoblock wireless communication devices that have a small, fixed overall size. Extendable slide wireless communication devices in which one portion of the handset body is movably connected to another portion with a slide connection and that are operable for two way communications only when the handset body portions are extended with respect to one another.

FIG. 2 illustrates a housing of a wireless communication device 100 in which the blocks of FIG. 1 can be implemented. As illustrated in FIG. 2, the communication device 100 includes a main housing 150 and a movable flip housing 110. The movable flip housing 110 has an open position (as shown) being hinged away from the main housing 150 and a closed position (not shown) being in proximity to the main housing 150.

The communication device 100 can include a user interface such as one or more of a display 107 (not shown in FIG. 2), a microphone 125 (not shown in FIG. 2), a keypad 140, and an earpiece speaker 127 and any other input devices 108 (not shown in FIG. 2) that are known in the art. A hinge assembly 125 mechanically connects the main housing 150 and the movable flip housing 110. The movable flip housing 110 preferably is moveably coupled to the main housing 150 through the hinge assembly 125. The communication device 100 includes an antenna 106 (not shown in FIG. 2) for intercepting transmitted signals from one or more communication systems in which the communication device 100 operates and for transmitting signals to the one or more communication systems. The antenna system can be located internally or externally to the main housing 150 and/or to the movable flip housing 110.

The movable flip housing 110 has a width dimension extending in an x-direction, a thickness dimension extending in a y-direction, and a length dimension extending in a z-direction.

When the wireless communication device is in use and user is speaking, the main antenna generates an electric field having an x-component ($E_x^{MA}$) that is substantially aligned with the x-direction, a y-component ($E_y^{MA}$) that is substantially aligned with the y-direction, and a z-component ($E_z^{MA}$) that is substantially aligned with the z-direction.

In many common designs, the wireless communication device 100 will have a size on the order of approximately 50 mm by 100 mm by 20 mm, when in a closed position. There is constant effort to reduce this volume and make dimensions of the overall size of the device smaller. The continual reduction in housing dimensions has direct impact on how the user will interact with the wireless communication device, and in many cases this necessarily means that antennas will be closer to biologic tissue during use of the wireless communication device.

Figure 3:
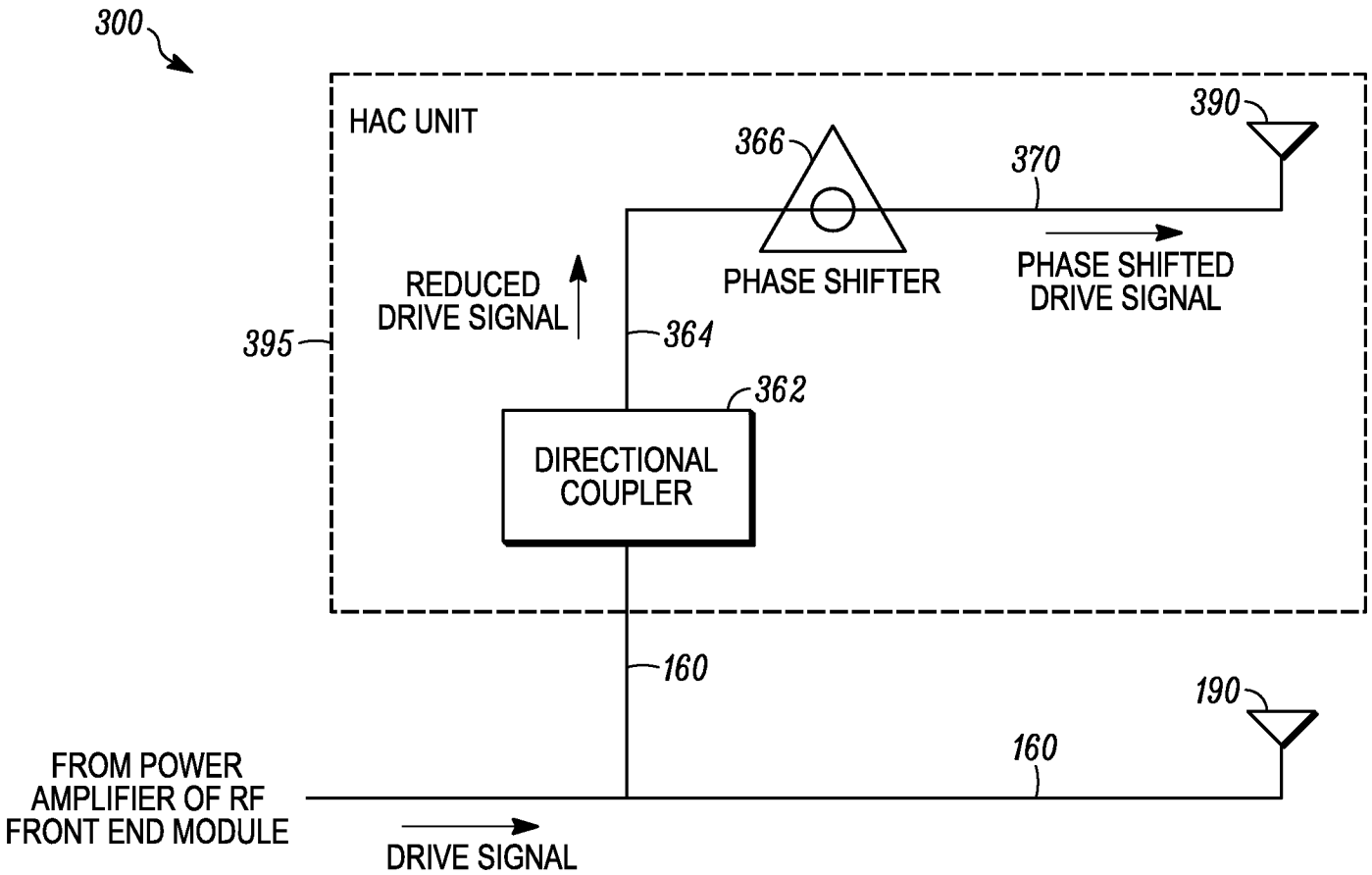
FIG. 3 is a block diagram of an antenna system of the wireless communication device in accordance with some of the disclosed embodiments.

FIG. 3 is a block diagram of a transmit diversity antenna system 300 of a wireless communication device in accordance with some of the disclosed embodiments. The antenna system 300 employs transmit diversity techniques to actively cancel at least a portion of an electric field generated by a main transmit antenna. Although not shown, the HAC unit and antenna system 300 can be implemented in conjunction with the wireless communication device 100 described with references to FIGS. 1 and 2.

Although not illustrated in FIG. 3, the baseband processor 110 of FIG. 1 generates a baseband information signal that is provided to the RF front end module 130. After various processing steps in the RF front end module, a power amplifier in the RF front end module generates an amplified RF signal that is the drive signal for the main antenna 190 and is to be transmitted as an uplink communication (i.e., from the wireless communication device to infrastructure such as a base station or access point). The amplified RF signal has a magnitude and a frequency at any particular instant and with respect to the main antenna 190 will be referred to as a first drive signal 160. The first drive signal 160 is eventually provided to the main antenna 190 and transmitted over the air. The amplified RF signal 160 is also provided to a coupler 362. In the description that follows, to differentiate the main drive signal 160 used to drive the main antenna 190 from another drive signal 370 used to drive auxiliary antenna structure 390, the drive signal 370 will be referred to below as a "second" phase-shifted drive signal 370.

The coupler 362 receives the amplified RF signal 160 and reduces its magnitude to generate a drive signal 364 having a "second" magnitude that is less than the first magnitude of the first drive signal 160 (e.g., by 10 dB or less). The coupler 362 should couple at −10 dB or less so that the reduction in magnitude does not significantly impact the Total Radiated Power (TRP) of main antenna. Although not illustrated, those skilled in the art will readily appreciate that the coupler 362 is a passive device used to couple part of the transmission power in a transmission line by a known amount out through another port, often by using two transmission lines set close enough together such that energy passing through one is coupled to the other.

The coupler 362 is coupled to a phase shifter 366. The phase shifter 366 is a device that provides a discrete phase shift to the input signal, which in this case is the drive signal 364, to shift to a desired angle. The phase shifter 366 can be implemented using either a passive or active phase shifter device either of which can be analog or digital. In one embodiment, the phase shifter 366 can be a passive phase shifter device. In general, at any particular instant, the phase-shifted drive signal 370 will have a lower magnitude than the first drive signal 160 and will be phase shifted with respect to the first drive signal 160. As will be described below, this allows a near-field component of the electric field ($E^{AA}$) generated by the auxiliary antenna structure 390 to destructively interfere with the near-field component of electric field ($E^{MA}$) generated by the main antenna 190.

In some embodiments, the optimal phase shift applied to the drive signal 370 can be determined by conducting a phase sweep of the auxiliary antenna structure during antenna system development. This way, an optimal phase shift can be determined. The optimal phase shift will cause the auxiliary antenna structure 390 to generate an optimal destructive electric field ($E^{AA}$) having a near-field component designed for cancellation of the near-field component of electric field ($E^{MA}$) generated by the main antenna 190 at a hot spot location. As will be explained below, the optimal phase shift is determined on a frequency-band-by-frequency-band basis (i.e., for a particular band of transmit frequencies). In this regard, the angle of the phase shift applied by the phase shifter 366 will depend on the frequency band that the transmitter is operating in; however, the angle of the phase shift applied by the phase shifter 366 for a particular frequency band will generally be the same for different sub-frequencies within same frequency band, and will allow a near-field component of the electric field ($E^{AA}$) generated by the auxiliary antenna structure 390 to destructively interfere with a near-field component of the electric field ($E^{MA}$) generated by the main antenna 190. For example, in the context of a radio (e.g., CDMA radio) that operates over 800 MHz and 1900 MHz bands, the phase shifter 366 will apply a particular phase shift angle to the drive signal 364 to reduce the intensity of the near-field component of the electric field ($E^{MA}$) generated at a hot spot location (by the main antenna 190) for all frequencies in the 800 MHz frequency band. By contrast, the phase shifter 366 applies a different phase shift angle to the drive signal 364 to mitigate a hot spot (associated with the near-field component of the electric field ($E^{MA}$) generated by the main antenna 190) for all frequencies in the 1900 MHz frequency band. In one non-limiting implementation, the optimal phase shift applied to the drive signal 364 was determined to be 140 degrees at a transmit frequency of 836 MHz.

In other embodiments, the phase shifter 366 can be an adjustable phase shifter device that allows the user of the wireless communication device to adjust the amount of phase shift that is applied to the drive signal 364 in real time during a call, which in turn allows for the intensity of a net near-field component of the electric field (i.e., sum of the near-field component of the electric field from main antenna 190 and the near-field component of the electric field from the auxiliary antenna 390) radiated by the wireless communication device to be controllable.

The main antenna 190 can be disposed inside the housing. The main antenna can be any known antenna including a microstrip or patch antenna that can be printed directly onto a circuit board. In one exemplary implementation, the main antenna 190 can be a Planar Inverted F Antenna (PIFA). The main antenna 190 is designed to generate/radiate a first near-field component of the electric field ($E^{MA}$) in response to the first drive signal 160. The near-field component of first electric field ($E^{MA}$) has a maximum intensity at a hot spot location. For instance, under the HAC Act, RF Emission ratings are based on peak field strength as measured at various points within a plane (e.g., a 5×5 cm grid) in the region that is located at a distance above the earpiece speaker. The hot spot location is a near-field component of the electric field that has the highest intensity and is represented by the region or area on a HAC sub-grid or sub-grids that has the highest intensity electric field. As will be described below, the near-field component of the first electric field ($E^{MA}$) has an x-component ($E_x^{MA}$), a y-component ($E_y^{MA}$) and a z-component ($E_z^{MA}$), which will be referred to below as a first x-component ($E_x^{MA}$), a first y-component ($E_y^{MA}$) and a first z-component ($E_z^{MA}$) to differentiate them from components of a near-field component of the electric field generated by the auxiliary antenna structure 390. The relative field strength of radio signals can be measured in free space by sampling one near-field component of the electric field. The intensity or strength of the first electric field ($E^{MA}$) is measured in volts per meter (V/m) or a fractional unit such as millivolt per meter (mV/m) or microvolt per meter (μV/m) is equal to $10^{-6}$ V/m. In some implementations (e.g., wireless communication handsets), it has been observed that a majority of the near-field component of the first electric field ($E^{MA}$) at the hot spot location is attributable to the first z-component ($E_z^{MA}$). In other implementations (e.g., two-way radios, etc.), the majority of the near-field component of the first electric field ($E^{MA}$) at the hot spot location can be attributable to the first z-component ($E_z^{MA}$) and/or one or more of the other components ($E_x^{MA}$, $E_y^{MA}$). In these other implementations, the similar techniques can be applied to mitigate the near-field components in other orientations.

The auxiliary antenna structure 390 can be an implemented using any known resonant or non-resonant structure for radiating electromagnetic energy in the frequency range containing the wireless carrier frequencies. As used herein, the term "non-resonant" refers to an antenna which does not have natural frequencies of oscillation, and responds equally well to radiation over a broad range of frequencies. A non-resonant antenna has approximately constant input impedance over a wide range of frequencies, and does not have natural resonance on frequency bands over which the main antenna transmits. The non-resonant auxiliary antenna structure 390 does not significantly degrade radiated performance of with the main antenna 190 due good isolation and therefore minimal coupling. The non-resonant structure does not have natural resonance in the same frequency band of the main antenna, therefore, increasing natural isolation between both structures, therefore minimizing the amount of energy that one structure will couple from each other. Use of non-resonant auxiliary antenna structure 390 may be preferable in some implementations since resonant structures can create other design constraints that are wavelength dependent, and also require isolation to minimize coupling with the main antenna 190. As such, the non-resonant structure is as effective as resonant structures without additional design constrains associated with in band resonance.

The auxiliary antenna structure 390 can be coupled and matched to the phase shifter using one or more transmission lines (not illustrated) and one or more sections of coaxial cable (not illustrated) as is known in the art.

The auxiliary antenna structure 390 is driven by the phase-shifted drive signal 370, which is a sample of main antenna drive signal 160 after having a phase shift applied and its magnitude reduced (e.g., 10 dB lower or more) with respect to the first drive signal 170. The phase shift of the phase-shifted drive signal 370 can be selected such that the auxiliary antenna structure 390 generates enough destructive interference to reduce the magnitude of the near-field component of the first electric field ($E^{MA}$) at the hot spot location.

The auxiliary antenna structure 390 can have any known shape that will allow it to generate a destructive electric field with respect to the near-field component of the first electric field ($E^{MA}$) generated by the main antenna 190. In some embodiments, the shape and orientation of the auxiliary antenna structure 390 are designed to generate a second electric field ($E^{MA}$) having a near-field component in the same orientation of the near-field component of the first electric field ($E^{MA}$) generated by the main antenna 190. In such embodiments, in response to the phase-shifted drive signal 370, the auxiliary antenna structure 390 generates/radiates a second electric field having a near-field component that has a second x-component ($E_x^{AA}$) that is substantially oriented with the first x-component ($E_x$MA), a second y-component ($E_y^{AA}$) that is substantially oriented with the first y-component ($E_y^{MA}$), and a second z-component ($E_z^{AA}$) that is substantially oriented with the first z-component ($E_z^{MA}$).

When considering the principle of superposition, the total near-field component of the electric field ($E^{Total}$) at any point is equal to the vector sum of the respective near-field components of the electric fields that each antenna would create in the absence of the others, and can be defined in Equation 1 as:

$$E^{Total}=E^{MA}+E^{AA} \quad \text{(Equation 1)}$$

The near-field component of the total electric field ($E^{Total}$) can also be written in Equation 2 as:

$$E^{Total}=(E_x^{MA}+E_y^{MA}+E_z^{MA})+(E_x^{AA}+E_y^{AA}+E_z^{AA}) \quad \text{(Equation 2)}$$

The near-field component of the total electric field ($E^{Total}$) can also be defined in Equation 3 as:

$$E^{Total}(x,y,z)=j\omega\mu\iiint_V J(x^A,y^A,z^A)G(x^A,y^Z,z^A)e^{-j\omega t}+ j\omega\mu\iiint_V J(x^W,y^W,z^W)G(x^W,y^W,z^W)e^{-j\omega(t-\phi)}dxdzdz \quad \text{(Equation 3)}$$

where ω is angular velocity (radians/second), μ is permeability (H/m), J is the electric current density, G is the three-dimensional homogeneous Green's function, t is time and ϕ is the phase shift of phase-shifted drive signal 370. Equation 3 shows that the electric near-field destructive interference, takes into account the phase shift of phase-shifted drive signal 370 transmitted by the auxiliary antenna 390 in relation to first drive signal 160 transmitted by the main antenna 190.

FIGS. 4A-4D illustrate various views of the physical layout of various components of a wireless communication device 400 in accordance with one exemplary implementation of the disclosed embodiments.

Figure 4A:
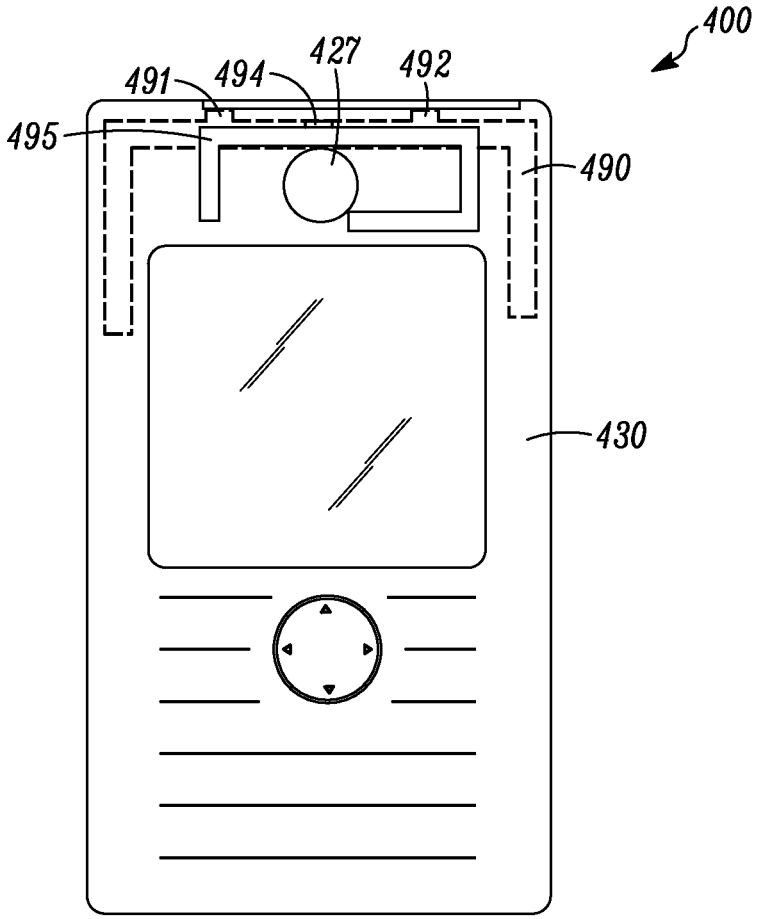
FIGS. 4A-4D illustrate various views of the physical layout of various components of a wireless communication device in accordance with one exemplary implementation of the disclosed embodiments.

FIG. 4A is a top plan view of a circuit board 430 assembly in accordance with one exemplary implementation of the disclosed embodiments. The circuit board 430 assembly is incorporated within a housing (not illustrated in FIG. 4A). The circuit board 430 assembly includes an earpiece speaker 427, a main antenna 490 and an auxiliary antenna structure 495. In FIG. 4A, the main antenna 490 is illustrated on a far side of the board in phantom and the auxiliary antenna structure 495 is illustrated in solid relative to a near side of the circuit board 430.

Figure 4B:
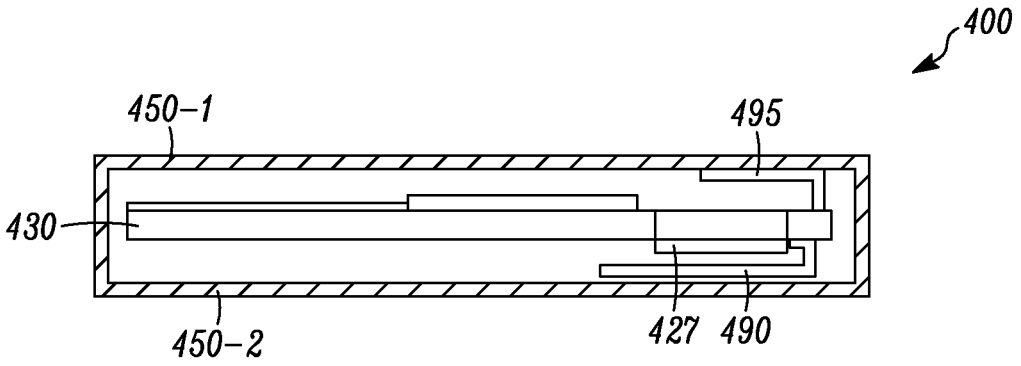

FIG. 4B is a side cross sectional view of a wireless communication device 400 in accordance with one exemplary implementation of the disclosed embodiments. The wireless communication device 400 includes the circuit board 430 assembly of FIG. 4A and a housing that includes a front housing 450-1 and a rear housing 450-2. The front housing 450-1 and rear housing 450-2 are assembled to form an enclosure for various components including the circuit board 430, the earpiece speaker 427, the main antenna 490 and the auxiliary antenna structure 495. The earpiece speaker 427, the main antenna 490 and the auxiliary antenna structure 495 are mounted on the circuit board 430. The auxiliary antenna structure 495 can be disposed inside the housing 450 in close proximity to the earpiece speaker 427. In this particular implementation the auxiliary antenna structure 495 is disposed at/near an upper portion of the front housing 450-1 of the device 400 at a location that will be underneath (or below) the hot spot location (not illustrated) associated with the main antenna 490.

Figure 4C:
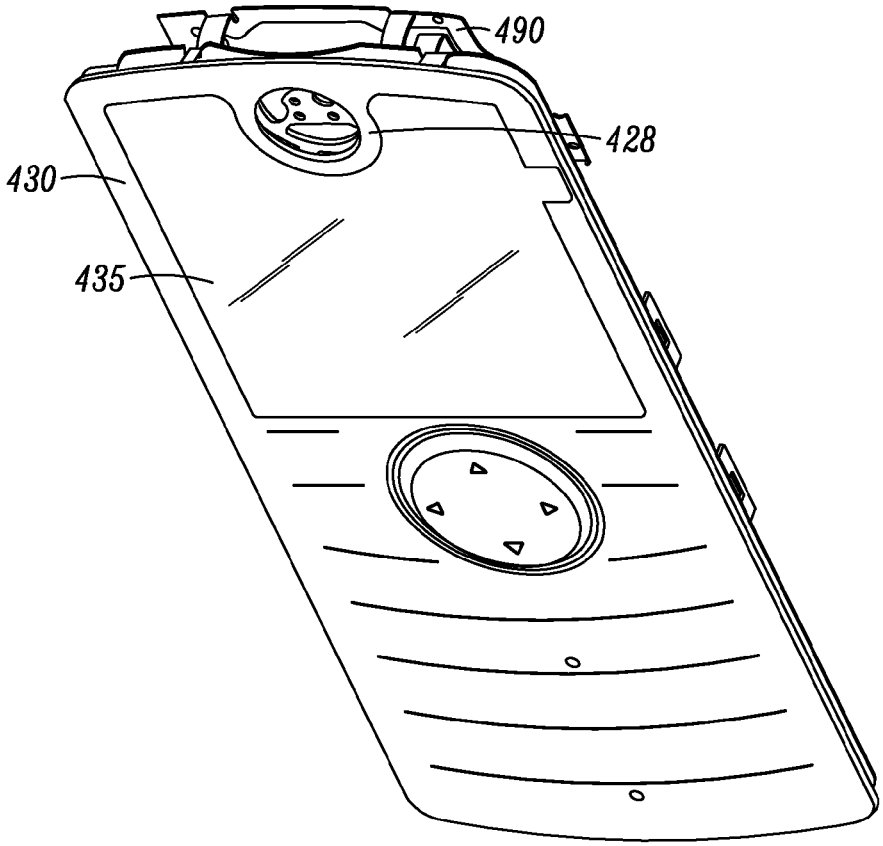

FIG. 4C is a front view of the circuit board 430 assembly of FIG. 4A in accordance with one exemplary implementation of the disclosed embodiments. FIG. 4C illustrates the location of the main antenna 490 on the circuit board 430 with respect to a display 435 and an opening 428 for the earpiece speaker.

Figure 4D:
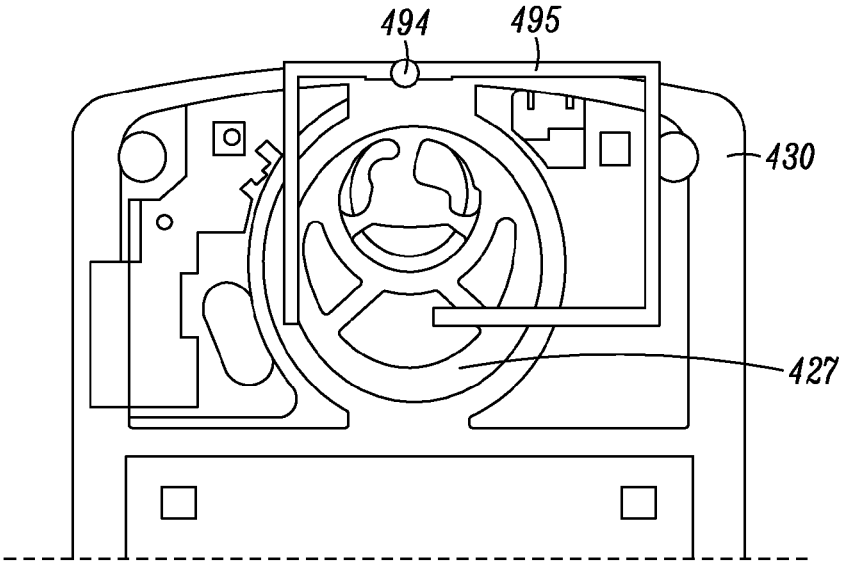

FIG. 4D is a rear view of the circuit board 430 assembly of FIG. 4A in accordance with one exemplary implementation of the disclosed embodiments. FIG. 4D illustrates the layout of the auxiliary antenna structure 495 on the circuit board 430 assembly with respect to the earpiece speaker 427 as well as a feed point 496 for the auxiliary antenna 495.

As illustrated in FIG. 4A, the main antenna 490 is coupled between a ground point 491 and a feed point 492, and the ground point 491 is coupled to a circuit board 430. The feed point 492 for the main antenna 490 receives a drive signal causing the main antenna 490 to radiate a first electric field ($E^{MA}$) having a first near-field component. The feed point 496 for the auxiliary antenna 495 receives a phase-shifted drive signal output by a phase shifter (not shown) and provides it to the auxiliary antenna structure 495 causing it to radiate a second electric field ($E^{AA}$) having a second near-field component. Placing the auxiliary antenna structure 495 in close proximity to the earpiece speaker 427 at a location underneath (or below) the hot spot location facilitates cancellation of the near-field component of the first electric field ($E^{MA}$) generated by the main antenna 490. This way the near-field component of the overall electric field that is incident at an imaginary "HAC" plane or surface that is located above the earpiece speaker 427 can be mitigated.

Figure 5A:
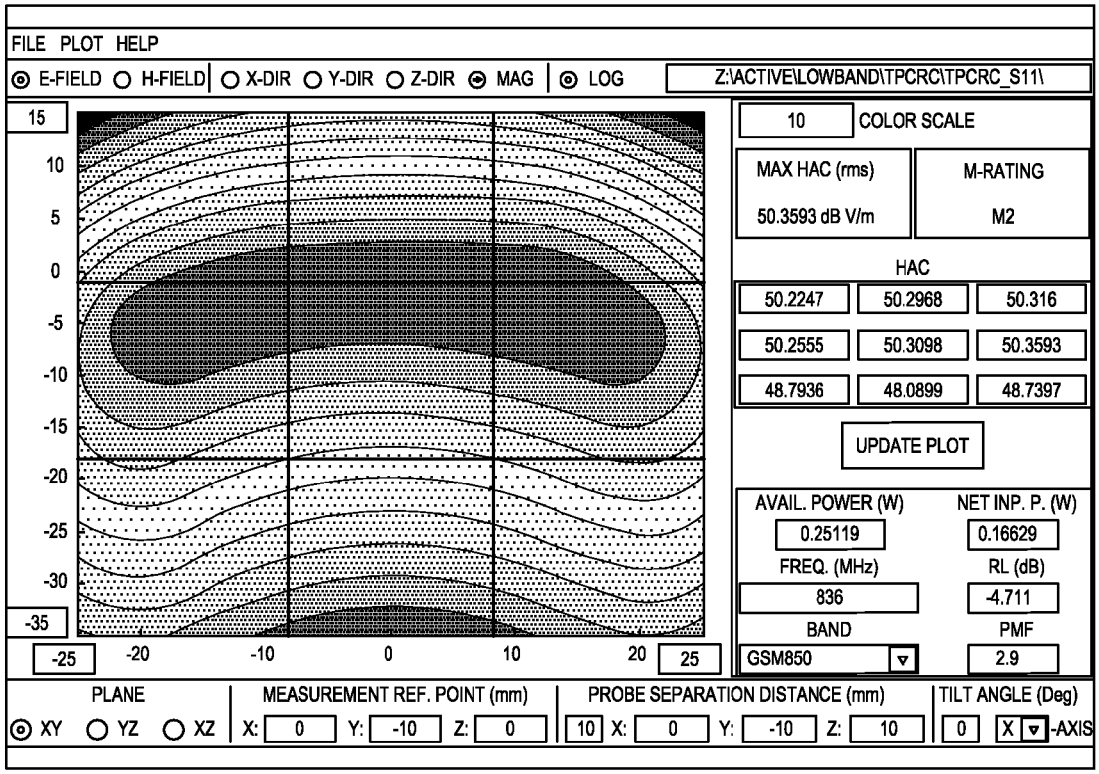
FIG. 5A is a user interface that includes a graphical portion illustrating a near-field component of an electric field ($E^{MA}$) generated by a main antenna with respect to a HAC grid.

FIG. 5A is a user interface that includes a graphical portion illustrating a near-field component of the first electric field ($E^{MA}$) generated by a main antenna 190 including a hot spot location (i.e., the darkest shaded area) with respect to a HAC grid. The graphical portion of the user interface was generated via computer simulation, and the HAC grid is shown here as nine boxes superposed on the graph.

Figure 6A:
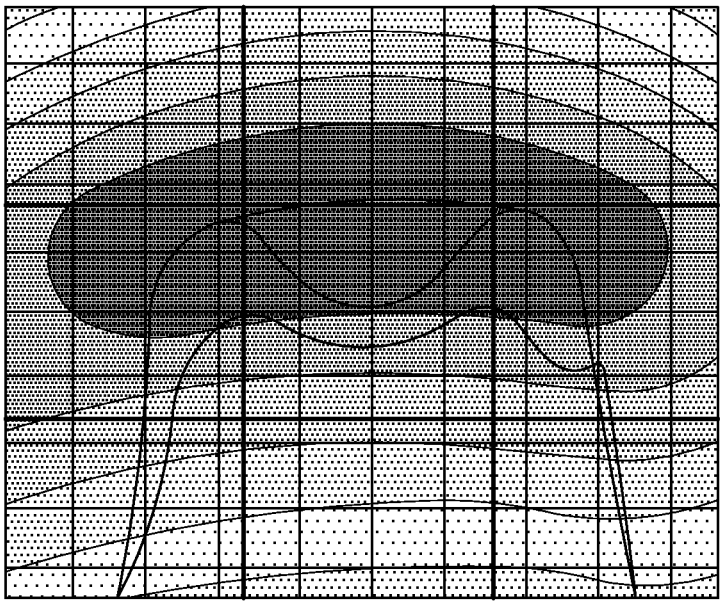
FIG. 6A is a graph of a measured near-field component of the electric field ($E^{MA}$) which corresponds to that shown in FIG. 5A.

FIG. 6A is a graph of a measured near-field component of the first electric field ($E^{MA}$) which corresponds to that shown in FIG. 5A. Thus, as opposed to the simulation illustrated in FIG. 5A, FIG. 6A illustrates an actual measured near-field component of the first electric field ($E^{MA}$). In FIG. 6A, the shading is used to indicate relative intensity of the near-field component of the first electric field ($E^{MA}$). Darker shading represents a more intense near-field component of the first electric field ($E^{MA}$) and lighter shading represents a less intense near-field component of the first electric field ($E^{MA}$). The hot spot location or region is represented by the darkest shaded area. FIG. 6A also includes an outline superposed thereon that represents part of a wireless communication device to illustrate the hot spot location with respect to an earpiece speaker of the wireless communication device. As shown, the hot spot location overlaps with the location of the earpeice speaker. It is noted that the outline of the wireless communication device that is superposed on FIG. 6A is not intended to be limiting, does not necessarily represent the actual shape of the wireless communication device and is not necessarily to scale. Instead, it is provided merely to illustrate a HAC grid and the hot spot location with respect to one possible implementation of an earpiece speaker of a wireless communication device.

Figure 5B:
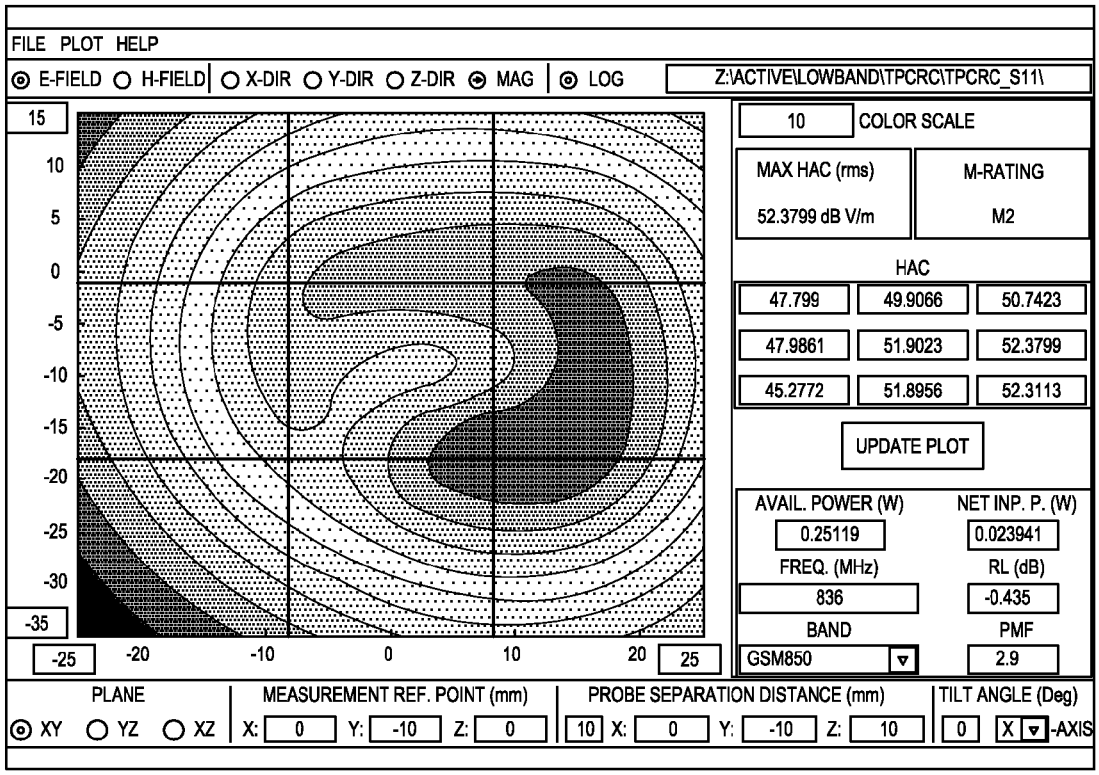
FIG. 5B is a user interface that includes a graphical portion illustrating a near-field component of an electric field ($E^{AA}$) generated by an auxiliary antenna with respect to the HAC grid.

FIG. 5B is a user interface that includes a graphical portion illustrating a near-field component of the second electric field ($E^{AA}$) generated by an auxiliary antenna 390 with respect to a HAC grid. Again, the graphical portion of the user interface was generated via computer simulation, and the HAC grid is shown here as nine boxes superposed on the graphical portion of the user interface.

Figure 6B:
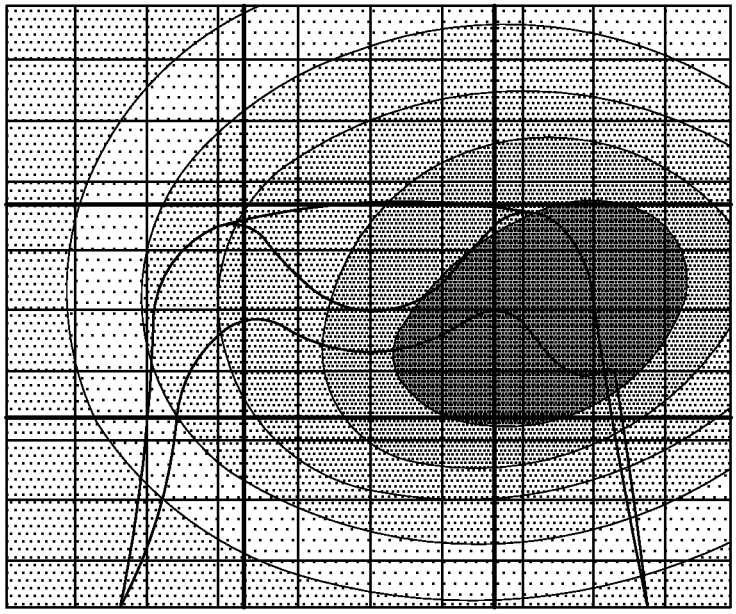
FIG. 6B is a graph of a measured near-field component of the electric field ($E^{AA}$) which corresponds to that shown in FIG. 5B.

FIG. 6B is a graph of a measured near-field component of the electric field ($E^{AA}$) which corresponds to that shown in FIG. 5B. Thus, as opposed to the simulation illustrated in FIG. 5B, FIG. 6B illustrates an actual measured near-field component of the electric field ($E^{AA}$). As above, FIG. 6B includes the outline superposed thereon that represents part of a wireless communication device to illustrate the near-field component of the second electric field ($E^{AA}$) generated by an auxiliary antenna 390 with respect to an earpiece speaker of the wireless communication device. In FIG. 6B, the shading is used to indicate relative intensity of the near-field component of the second electric field ($E^{AA}$). Darker shading represents a more intense near-field component of the second electric field ($E^{AA}$) and lighter shading represents a less intense near-field component of the second electric field ($E^{AA}$).

Figure 5C:
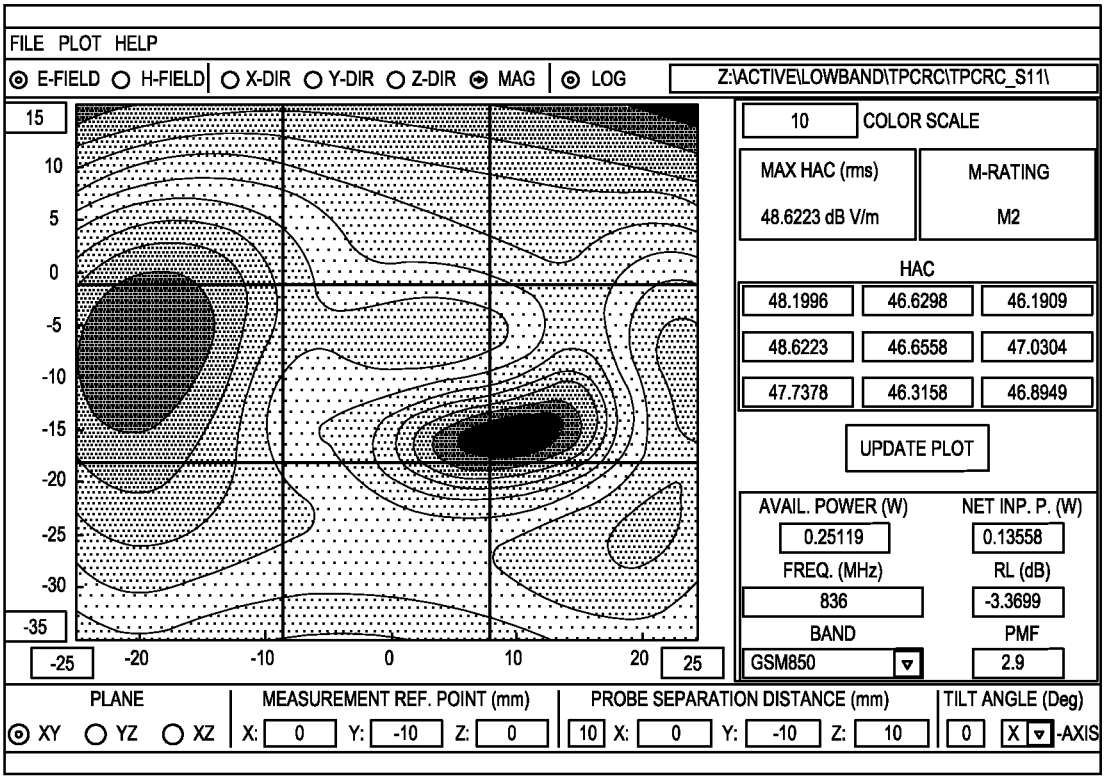
FIG. 5C is a user interface that includes a graphical portion illustrating a near-field component of the net electric field generated by the wireless communication device when the near-field component of the electric field ($E^{MA}$) is combined with the near-field component of the electric field ($E^{AA}$)

FIG. 5C is a user interface that includes a graphical portion illustrating a near-field component of the net electric field generated by the wireless communication device when the near-field component of the first electric field ($E^{MA}$) generated by the main antenna 190 is combined with the near-field component of the second electric field ($E^{AA}$) generated by the auxiliary antenna 390. Again, the graph of the net electric field was generated via computer simulation and is shown with respect to a HAC grid illustrated as nine boxes superposed on the graphical portion of the user interface.

Figure 6C:
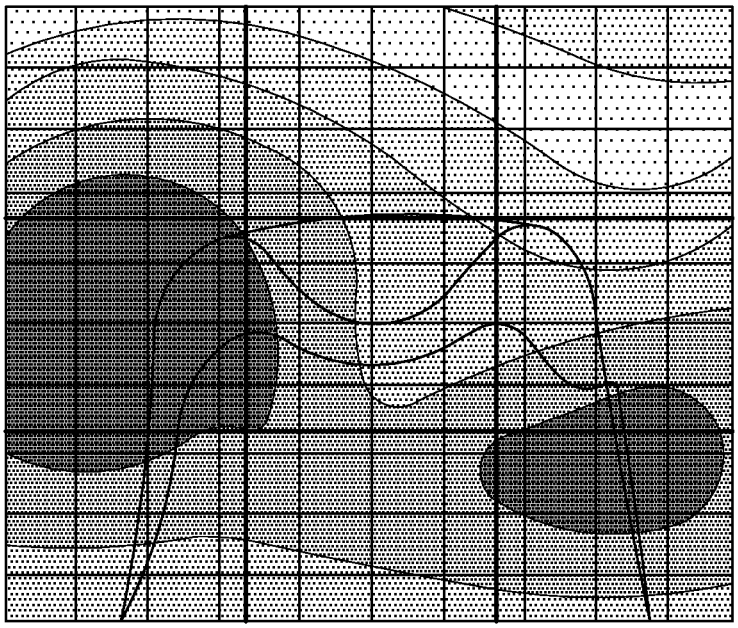
FIG. 6C is a graph of a measured near-field component of the net electric field which corresponds to that illustrated in FIG. 5C.

FIG. 6C is a graph of a measured near-field component of the net electric field which corresponds to that illustrated in FIG. 5C. The near-field component of the net electric field results when the near-field component of the electric field ($E^{MA}$) generated by the main antenna 190 is combined or "superposed" with the near-field component of the electric field ($E^{AA}$) generated by the auxiliary antenna 390. Like FIGS. 6A and 5B, FIG. 6C has the outline superposed thereon that represents part of the wireless communication device, and different shading is used to indicate relative intensity of the near-field component of the net electric field. Darker shading represents a more intense near-field component of the net electric field and lighter shading represents a less intense near-field component of the net electric field. In comparison to FIG. 6A, it can be seen that in FIG. 6C the hot spot location or region (that is represented by the darkest shaded area) is shifted away from the location where the speaker earpeice of the wireless communication device is located.

Taken together FIGS. 6A through 6C illustrate that the near-field component of the second electric field ($E^{AA}$) has sufficient magnitude to cancel/reduce the near-field component of the first electric field ($E^{MA}$) at the hot spot location. In other words, when the near-field component of the second electric field ($E^{AA}$) is superposed on the near-field component of the first electric field ($E^{MA}$), the near-field component of the second electric field ($E^{AA}$) is destructive and cancels at least a portion of the first electric field ($E^{MA}$) to thereby reduce the magnitude of the near-field component of the first electric field ($E^{MA}$) that is incident at the hot spot location.

Thus, by utilizing the principle of superposition, at least part of the first electric field ($E^{MA}$) generated by main antenna 190 is actively cancelled by the second electric field generated that is generated by the auxiliary antenna structure 390. As such, the disclosed embodiments can be used to reduce or mitigate undesirable electric near-field radiation against a user of a wireless communication device. For example, the incidence of an electric near-field on biologic tissue or a hearing aid can be reduced. In such implementations, the disclosed embodiments can be used to reduce biologic tissue energy absorption (e.g., as evidenced by Specific Absorption Rate (SAR) levels), and/or can be used to reduce undesirable signal rectification on hearing aid components (e.g., as evidenced via Hearing Aid Compatibility (HAC) levels defined in the FCC's HAC Act).

It should be appreciated that the exemplary embodiments described with reference to FIG. 1-6C are not limiting and that other variations exist. It should understood that various changes can be made without departing from the scope of the invention as set forth in the appended claims and the legal equivalents thereof. The embodiment described with reference to FIGS. 1-4 can be implemented a wide variety of different implementations.

Those of skill will appreciate that the various illustrative logical blocks, modules, circuits, and steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. As used herein the term "module" refers to a device, a circuit, an electrical component, and/or a software based component for performing a task. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Furthermore, the connecting lines or arrows shown in the various figures contained herein are intended to represent example functional relationships and/or couplings between the various elements. Many alternative or additional functional relationships or couplings may be present in a practical embodiment.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method of operating a wireless communication device comprising a housing, an earpiece speaker integrated with the housing, a main antenna, and an a auxiliary antenna structure disposed inside the housing at a location in close proximity to the earpiece speaker, the method comprising the steps of:

reducing a first magnitude of an amplified RF signal to generate a drive signal having a second magnitude that is less than the first magnitude;

shifting a phase angle of the drive signal to generate a phase-shifted drive signal that is phase shifted with respect to the amplified RF signal; and driving the main antenna with the amplified RF signal to radiate a first electric field having a first near-field component and a far-field component, wherein the first near-field component of the first electric field has a maximum intensity at a hot spot location and has a first x-component, a first y-component and a first z-component, and simultaneously driving the auxiliary antenna structure with the phase-shifted drive signal to radiate a second electric field having a second near-field component that reduces the magnitude of the first near-field component without causing destructive interference with respect to the far-field component of the first electric field, wherein the auxiliary antenna structure is oriented to radiate the second electric field in the same orientation as the first electric field generated by the main antenna, wherein the second near-field component of the second electric field has a second x-component that is substantially oriented with the first x-component, a second y-component that is substantially oriented with the first y-component, and a second z-component that is substantially oriented with the first z-component, and wherein the second near-field component destructively interferes with the first near-field component and reduces the magnitude of the first near-field component that is incident at the hot spot location.

2. A method according to claim 1, wherein the auxiliary antenna structure is disposed underneath the hot spot location.

3. A method according to claim 1, wherein the auxiliary antenna structure is a non-resonant auxiliary antenna structure that does not have natural frequencies of oscillation and does not have natural resonance on frequency bands that the main antenna operates over.

4. A method according to claim 1, wherein the phase shifter comprises an adjustable phase shifter, and further comprising the step of:

adjusting a phase shift applied to the drive signal to control the phase of the second electric field.

5. A method according to claim 1, wherein the step of shifting the phase of the drive signal to generate a phase-shifted drive signal having an angle that is phase shifted with respect to the amplified RF signal, comprises:

applying a discrete phase shift to the drive signal to generate a phase-shifted drive signal having a phase angle that is phase shifted with respect to the amplified RF signal such that the auxiliary antenna structure generates destructive interference to reduce the magnitude of the first near-field component at the hot spot location.

6. A method according to claim 1, wherein the main antenna is disposed within the housing.

7. A wireless communication device, comprising:

a housing; an earpiece speaker integrated with the housing; a main antenna designed to radiate, in response to an amplified RF signal having a first magnitude, a first electric field having a far-field component and a first near-field component that has a maximum intensity at a hot spot location;

a coupler designed to receive the amplified RF signal and to reduce the first magnitude of the amplified RF signal to generate a drive signal having a phase angle and a second magnitude that is less than the first magnitude;

a phase shifter, coupled to the coupler and being designed to receive the drive signal, the phase shifter being designed to shift the phase angle of the drive signal to generate a phase-shifted drive signal that is phase shifted with respect to the amplified RF signal; and an auxiliary antenna structure coupled to the phase shifter and being disposed inside the housing beneath the hot spot location and in close proximity to the earpiece speaker, the auxiliary antenna structure being designed to radiate, in response to the phase-shifted drive signal, a second electric field having a second near-field component that reduces the magnitude of the first near-field component at the hot spot location without causing destructive interference with respect to the far-field component of the first electric field, wherein the auxiliary antenna structure is oriented to radiate the second near-field component in the same orientation as the first near-field component, wherein the first near-field component of the first electric field has a first x-component, a first y-component and a first z-component, wherein the near-field component of the second electric field has a second x-component that is substantially oriented with the first x-component, a second y-component that is substantially oriented with the first y- component, and a second z- component that is substantially oriented with the first z-component, and wherein the second near-field component destructively interferes with the first near-field component to reduce the first near-field component at the hot spot location.

8. A wireless communication device according to claim 7, wherein the second near-field component reduces the first near-field component that is incident at the hot spot location.

9. A wireless communication device according to claim 7, wherein the auxiliary antenna structure is a non-resonant auxiliary antenna structure that does not have natural frequencies of oscillation and does not have natural resonance on frequency bands that the main antenna operates over.

10. A wireless communication device according to claim 7, wherein the phase shifter comprises an adjustable phase shifter that allows a phase shift applied to the drive signal to be adjusted so that a phase of the second electric field is controllable.

11. A wireless communication device according to claim 7, wherein the phase shifter applies a discrete phase shift to the drive signal to generate the phase-shifted drive signal, wherein the phase angle of the phase-shifted drive signal is phase shifted with respect to the amplified RF signal such that the auxiliary antenna structure generates destructive interference to reduce the magnitude of the first near-field component at the hot spot location.

12. A method according to claim 7, wherein the main antenna is disposed within the housing.

* * * * *